United States Patent [19]

Midolo

[11] 4,187,692

[45] Feb. 12, 1980

[54] LIQUID COOLED ROTARY VANE AIR CYCLE MACHINE

[76] Inventor: Lawrence L. Midolo, 1475 Black Oak Dr., Centerville, Ohio 45459

[21] Appl. No.: 902,524

[22] Filed: May 3, 1978

[51] Int. Cl.[2] ..... F25D 9/00

[52] U.S. Cl. ..... 62/402; 123/119 CD; 418/85

[58] Field of Search ..... 62/86, 402, 499, 505; 418/83, 85, 86; 123/119 CD

[56] References Cited

U.S. PATENT DOCUMENTS

| | | | |
|---|---|---|---|
| 3,424,135 | 1/1969 | Tado | 418/86 |
| 3,884,664 | 5/1975 | Edwards | 62/402 |
| 4,117,695 | 10/1978 | Hargreaves | 62/86 |

*Primary Examiner*—Ronald C. Capossela

*Attorney, Agent, or Firm*—Joseph E. Rusz; Richard J. Killoren

[57] ABSTRACT

An air cooling system having a rotary assembly within a non-circular chamber wherein compression and expansion used in a modified reverse Brayton cycle are provided within the same chamber by the change in volume brought about by vanes sliding within slots in the rotor. Air is supplied to the compressor portion of the chamber from an air-to-air heat exchanger which receives cooled air from the expander. A transfer passage is provided between the output of the compressor and the inlet of the expander. A liquid cooled heat exchanger is provided adjacent the compressor. A second liquid cooled heat exchanger is provided around the transfer passage. Coolant is supplied to the liquid cooled heat exchangers from a radiator.

1 Claim, 4 Drawing Figures

Fig. 1
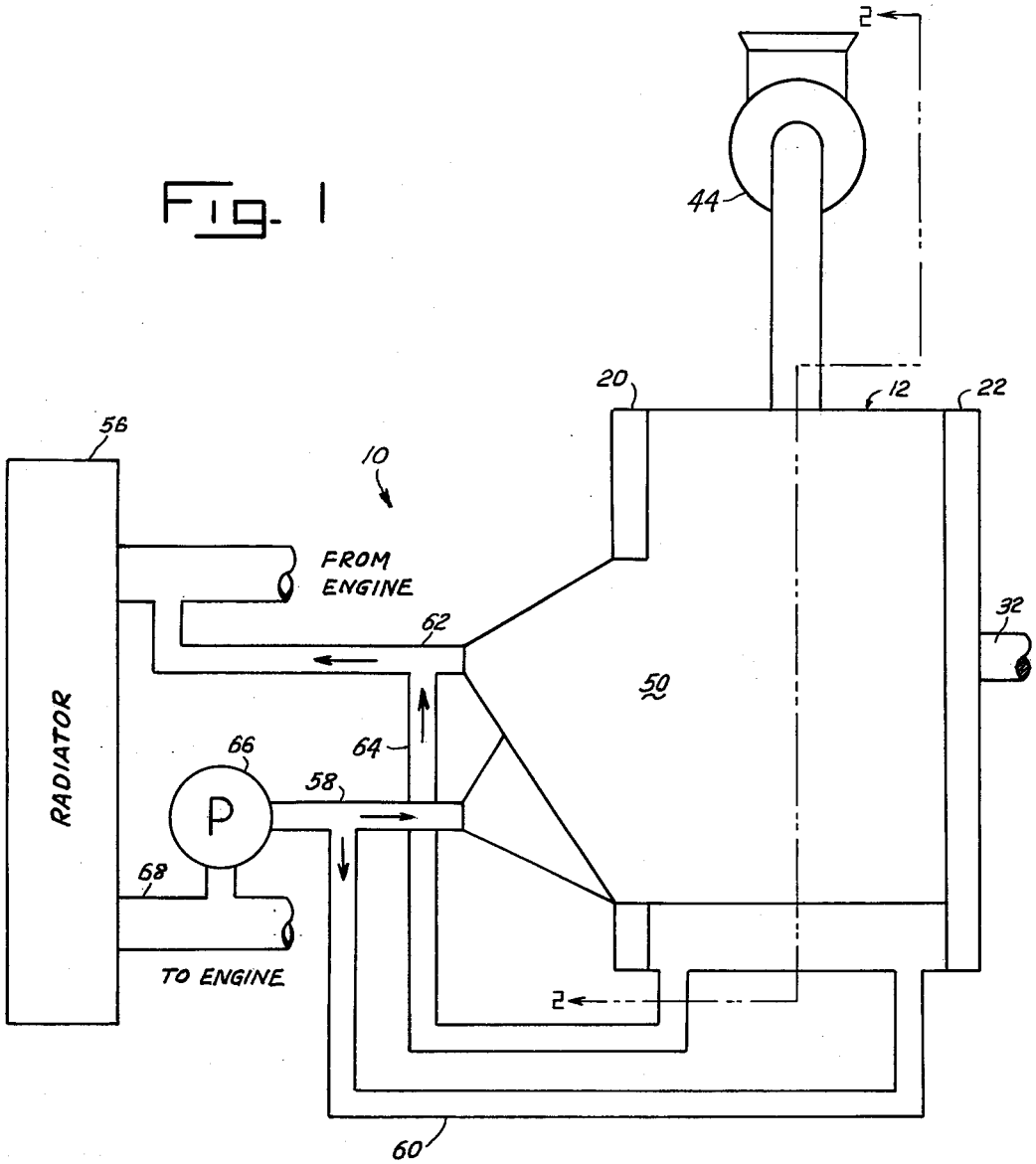
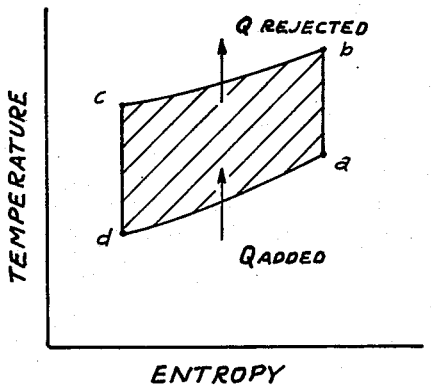
Fig. 3
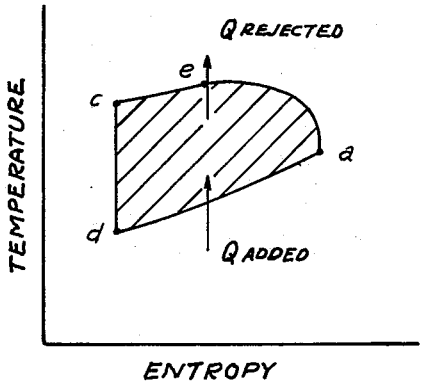
Fig. 4

LIQUID COOLED ROTARY VANE AIR CYCLE MACHINE

RIGHTS OF THE GOVERNMENT

The invention described herein may be manufactured and used by or for the Government of the United States for all governmental purposes without the payment of any royalty.

BACKGROUND OF THE INVENTION

A two phase liquid-vapor system is normally used in the air conditioning system for automobiles.

Single fluid air conditioning systems with air-to-air heat exchangers, using the reverse Brayton cycle have been proposed for use in automobiles. The U.S. patents to Edwards, Nos. 3,686,893; 3,967,466; and 3,977,852 describe such systems.

In the reverse Brayton cycle refrigeration system, air undergoes an isentropic compression followed by a reversible constant pressure cooling. The high pressure air then undergoes a reversible expansion. The cooled air then picks up heat at a constant pressure and is then returned to the compressor inlet. In the conventional reverse Brayton cycle refrigerating system, heat is not removed during the compression phase of the cycle.

BRIEF SUMMARY OF THE INVENTION

According to this invention, an air conditioning system is provided which operates on a modified reverse Brayton cycle. In the device of this invention, cooling is provided during the compression phase of the cycle. This reduces the work required to obtain the same heat transfer and thus increases the coefficient of performance of the system.

An air to liquid heat exchanger is used for cooling the air during the compression phase to provide a more efficient heat transfer. The liquid in the air to liquid heat exchanger can be passed to the car radiator which could be enlarged to handle the added heat load. While a slightly larger car radiator would be required, it would not have to be larger than those used with present two phase air conditioning systems. The overall size and complexity of the refrigeration system would be reduced.

IN THE DRAWING

FIG. 1 is a partially schematic diagram of a cooling system according to the invention.

FIG. 3 shows a temperature-entrophy diagram for a conventional reverse Brayton cycle device.

FIG. 4 shows a temperature-entrophy diagram for a modified reverse Brayton cycle used in the device of the invention.

DETAILED DESCRIPTION OF THE INVENTION

Figure 2:
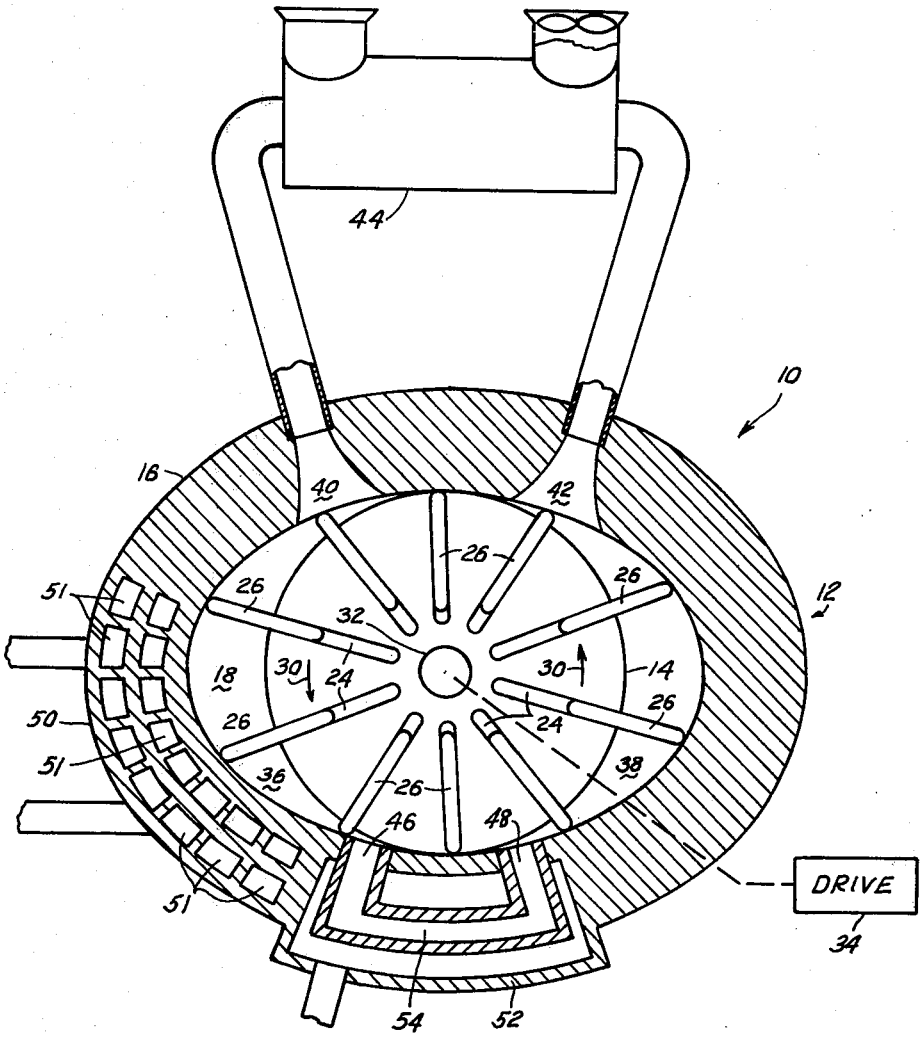
FIG. 2 is a partially schematic sectional view of the device of FIG. 1 along the line 2—2.

Reference is now made to FIGS. 1 and 2 of the drawing which show an air cooling system 10 including a conventional compressor-expander unit 12, such as shown and described in the patents to Edwards. The compressor-expander includes a rotor 14 within a housing 16 which forms the wall of a non-circular chamber 18. End members 20 and 22, shown in FIG. 1, seal the ends of the chamber. The rotor 14 includes a plurality of radial slots 24 for receiving slidable vanes 26. Prior art blade guide means, not shown, may be provided. The rotor is driven in the direction shown by arrows 30 through shaft 32 by drive means 34. With the direction of rotation as shown by arrows 30, the side 36 will act as a compressor and the side 38 will act as an expander.

A gas such as air is supplied to the compressor through inlet 40 and is removed from the expander through outlet 42. The gas leaving the expander through outlet 42 passes through a heat exchanger 44 as in prior art devices. If a conventional air-to-air heat exchanger were connected between compressor outlet 46 and expander inlet 48, the device would operate with a conventional reverse Brayton cycle as represented in the temperature-entrophy diagram of FIG. 3, wherein the a–b leg represents the compression phase, b–c represents the cooling phase wherein heat is extracted in the normal air-to-air heat exchanger connected between the compressor outlet 46 and expander inlet 48, c–d represents the expander phase and d–a represents the heat addition phase wherein heat is added to the air in heat exchanger 44.

The coefficient of performance of a refrigeration cycle is the heat extracted at the low temperature divided by the work which must be supplied to operate the cycle. It can therefore be seen if less work is required in the compressor in moving from point a to point c in the diagram of FIG. 3 with c–d and d–a remaining unchanged, the coefficient of performance can be increased. If cooling is provided during the compression phase, less work will be required and the coefficient of performance will be increased.

A liquid cooled heat exchanger 50 is provided adjacent the compressor side 36, of chamber 18, which will extract heat during the compression phase of the cycle and will provide a modified reverse Brayton cycle as shown in FIG. 4 wherein leg a–c meets the leg b–c of the conventional reverse Brayton cycle at point e. The remainder of the heat rejection needed to arrive at point c will take place in liquid cooled heat exchanger 52. Heat exchangers 50 and 52 would be conventional compact plate and fin heat exchangers. In heat exchanger 52, the plates and fins, not shown, would be provided in the air flow passage between the compressor outlet 46 and the expander inlet 48. In heat exchanger 50 the fins, not shown, would be provided in the liquid flow passages 51. For some applications, sufficient cooling can be provided in heat exchanger 50 so that point e will coincide with point c in which case the heat exchanger 52 is not needed. In this case, only a transfer passage line 54 would be used.

The heat exchangers 50 and 52 could be supplied with coolant from radiator 56 through lines 58 and 60 with the return being supplied through lines 62 and 64. A pump 66 may be provided between engine return line 68 and the lines 58 and 60 to supply coolant to the heat exchangers. Though not shown, fins could be provided on lines 58 and 60 to provide additional heat extraction.

In the operation of the device of the invention, the gas entering the compressor 36 from heat exchanger 44 is compressed to a higher temperature and pressure. By removing heat with the heat exchanger 50 during compression, less work has to be done by drive means 34. Any additional heat that must be removed to bring the gas to the temperature and pressure at point c is then removed in the heat exchanger 52. Coolant is circulated between the radiator 56 and the heat exchangers 50 and 52 by a pump 66. The gas passing through the expander 38 and the heat exchanger 44 follow the legs c–d and d–a of the conventional reverse Brayton cycle.

There is thus provided an air cooling system which provides an improved coefficient of performance.

I claim:

1. A rotary vane air cycle apparatus, comprising: a compressor and an expander driven by a common shaft; said compressor and expander including a rotor having vanes which form a plurality of cells which change in volume as the shaft rotates; said compressor having an inlet port and an outlet port; said expander having an inlet port and an outlet port; and means for supplying a gas to the compressor inlet port; a passage interconnecting the compressor outlet port and the expander inlet port; means, adjacent said compressor for cooling the gas in said compressor during compression of the gas; said means for cooling the gas in the compressor including a liquid cooled heat exchanger; means for supplying cooling liquid to said heat exchanger; a liquid cooled heat exchanger surrounding the passage between the compressor outlet port and the expander inlet port.

* * * * *